US005605472A

United States Patent [19]

Sakai et al.

[11] Patent Number: 5,605,472

[45] Date of Patent: Feb. 25, 1997

[54] CONNECTOR FITTING DETECTION MECHANISM

[75] Inventors: Hitoshi Sakai; Kazuto Ohtaka, both of Haibara-gun, Japan

[73] Assignee: Yazaki Corporation, Tokyo, Japan

[21] Appl. No.: 499,576

[22] Filed: Jul. 7, 1995

[30] Foreign Application Priority Data

Jul. 12, 1994 [JP] Japan ..... 6-159857

[51] Int. Cl.[6] ..... H01R 3/00

[52] U.S. Cl. ..... 439/489

[58] Field of Search ..... 439/489, 352, 439/353, 354, 488

[56] References Cited

U.S. PATENT DOCUMENTS 5,120,255 6/1992 Kouda et al. ..... 439/489

FOREIGN PATENT DOCUMENTS 1-166977 11/1989 Japan .
3-285280 12/1991 Japan .
4-16887 2/1992 Japan .

*Primary Examiner*—P. Austin Bradley
*Assistant Examiner*—Yong Kim
*Attorney, Agent, or Firm*—Armstrong, Westerman, Hattori, McLeland & Naughton

[57] ABSTRACT

A resilient locking arm 4 formed on a connector housing 1, which is one of the two mating connector housings, is provided with a guiding section, and a connector fitting detection member 2 comprises a fitting section to be slidably engaged with the guiding section and a resilient detecting arm 17 having a locking projection 20 which is deflectable downward with respect to a locking protuberance 6 formed on the locking arm 4, wherein the locking projection 20 is slidable on the respective lowest end surfaces 10*a*, 6*a* respectively of a fitting projection 10 formed on the mating housing 9 and the locking protuberance 6 when the connectors are completely coupled with each other, and wherein the guiding section is formed on a pushing plate 7 provided further on the resilient locking arm, and a resilient fitting detecting arm 17 which is integrally formed to an operating section 16 of the fitting detection member 2 is urged downward with respect to the pushing plate.

3 Claims, 6 Drawing Sheets

CONNECTOR FITTING DETECTION MECHANISM

BACKGROUND OF THE INVENTION

1 Field of the Invention

The present invention relates to a perfect fitting detection mechanism for connectors which is capable of detecting whether or not a female and a male connector are perfectly fitted with each other just by sliding a fitting detection member which is mounted on a resilient locking arm provided to a connector housing.

2. Description of the Prior Art

An example of a prior art mechanism for detecting a perfect fitting of connectors is shown in FIGS. 9 to 12 (Japanese Patent Application Laid-Open No. Heisei 3-285280), wherein a detection of perfect fitting between a male and a female terminals, respectively denoted by 35 and 36, is conducted by slidably mounting a fitting detection member 33 to a male connector housing 32 having a resilient locking arm 31, and checking whether the fitting detection member 33 can be further pushed after the male connector housing 32 is inserted into the mating female connector housing 34.

The fitting detection member 33 comprises a locking groove 38 for receiving a guide rail 37 formed on the male connector housing 32, and a resilient detecting arm 41 having a locking projection 40 to be abutted against an end lock portion 39 of the resilient locking arm 31. In accordance with an inserting movement of the male connector 35 into the female connector 36, the resilient detecting arm 41 is deflected upward together with the locking arm 31 with the locking projection 40 thereof being locked to the end lock portion 39 of the locking arm 31, and on completing the fitting operation of the connectors, the detecting arm 41 is then mounted onto a mating locking projection 42 of the female connector housing 34, which projection being provided to be fitted with the end lock portion 39, as shown in FIG. 11. In other words, simultaneously with a completion of the coupling operation of the connectors, the locking arm 31 is restored from its deflection and the end lock portion 39 thereof is engaged with the locking projection 42, wherein the detecting arm 41 is still remained in the deflected state. From this situation, when pushing further the fitting detection member 33 forward, the locking projection 40 surmounts both the opposing locking projection 42 and the end lock portion 39 to restore from the deflection thereof. The fitting detection member 33 is retained on the male connector housing 32 with its locking projection 40 engaged with the end lock portion 39.

However, with the above construction, when the fitting detection member 33 is mounted onto the male connector housing 32, the rear end portion 33*a* thereof is rearwardly protruded, so that it easily comes off due to a friction with other external members during the transportation thereof or the like, and further on inserting a terminal 43 into the male connector housing 32 from the rear end thereof by an automatic assembler, the terminal 43 cannot be sufficiently inserted because of the rearwardly protruded fitting detection member 33. Still further, since the detecting arm 41 of the fitting detection member 33 is deflected together with the locking arm 31, the deflecting force of the locking arm 31 is increased, to thereby require a larger force for fitting the connectors, and consequently an operating force for releasing the locking arm 31 also becomes enlarged.

SUMMARY OF THE INVENTION

The present invention has been made to solve the above-mentioned problems, and accordingly, it is an object of the present invention to provide a mechanism for detecting a perfect fitting of two mating connectors in which an inadvertent disconnection of the fitting detection member during the transportation thereof, an insufficient insertion of a terminal, and also an increase in the force required for operating the locking arm for fitting and/or releasing the connectors can all be prevented, whereby a smooth connection and disconnection of the connectors can be effectuated.

In order to attain the above object, the present invention provides a mechanism for detecting a perfect fitting of two mating connectors; wherein in a state that a first connector housing having a locking arm provided with the locking protuberance formed thereon, and is provided with a locking detection member mounted thereon is coupled with a second connector housing having a fitting projection for receiving and engaged with the locking protuberance of the first connector, and that the locking detection member is slidable in the direction for coupling two connectors of the respective housings, the resilient locking arm includes a guiding section so that the fitting detection member slides therealong, the fitting detection member comprises a fitting section to be mated and fitted with the guiding section and a resilient fitting detecting arm having a locking projection to be engaged with the locking protuberance, wherein the locking projection is slidable on the respective lowest end surfaces of the fitting projection and the locking protuberance when the connectors are completely coupled to each other.

It is also possible to construct such that the guiding section is formed on a pushing plate of the resilient locking arm, the fitting detection member includes an operating section to be fitted with the pushing plate, the operating section is formed with a fitting section to be fitted with the guiding section, and that the resilient detecting arm is integrally formed to the operating section and set downward with respect to the pushing plate.

When the connectors are not coupled to each other yet, the fitting detection member is retained in such a manner that the locking projection of the resilient detecting arm thereof is abutted against the rear end of the locking protuberance of the resilient locking arm. When the locking arm advances and deflects in accordance with the sliding movement of the locking protuberance thereof, the fitting detection member also deflects and shifts together with the locking arm. However, the fitting detecting arm thereof never deflects. When the connectors are coupled to each other, the locking protuberance surmounts the fitting projection of the mating connector housing, the locking arm restores from the deflection thereof, and the locking protuberance is engaged with the rear end of the fitting projection. Simultaneously, the locking projection of the detecting arm of the fitting detection member abuts against the protruded end surface of the fitting projection of the mating connector and that of the locking protuberance of the locking arm. At this stage, the detecting arm is deflected downward. Then, by pushing the fitting detection member to slide in the direction for fitting the connectors, the locking projection slides along the protruded end surfaces of the fitting projection and the locking protuberance to restore the deflection thereof to the position forwardly of the locking protuberance (behind the fitting projection). By this sliding movement, a perfect fitting of the connectors is confirmed.

Other features and advantages of the invention will be apparent from the following description taken in connection with the accompanying drawing.

DETAILED DESCRIPTION OF THE PREFERRED EMBODIMENTS

Figure 1:
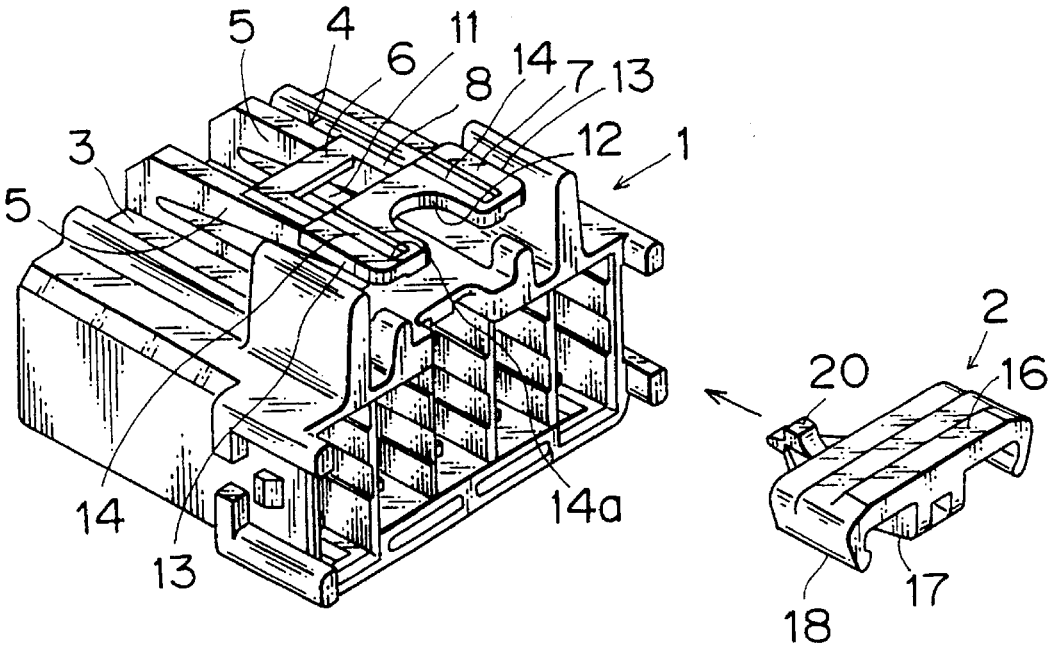
FIG. 1 is an exploded perspective view showing one embodiment of the mechanism for detecting a mutual fitting of two mating connectors according to the present invention.

FIGS. 1 to 8 show an embodiment of a mechanism for detecting whether the mating connectors are fitted to each other according to the present invention. In FIG. 1, reference numeral 1 denotes a male connector housing made of synthetic resin, 2 denotes a fitting detection member also made of synthetic resin plate to be mounted onto the male connector housing. A resilient locking arm 4 protrudes from the upper wall 3 of the male connector housing, and the fitting detection member 2 is retained on the resilient locking arm 4. The resilient locking arm 4 is composed of; a pair of side plates 5, 5 formed upright from the front end side of the upper surface 3, a flat plate-like locking protuberance 6 for connecting the pair of side plates 5, 5 in the intermediate section thereof, and also a horizontal pushing plate 7 for connecting the side plates 5, 5 at the rear end portion thereof.

The locking protuberance 6 is formed upwardly on the upper end surface of the side plate 5 and extending toward the rear end thereof, namely a pushing plate 7, to form a frame-like shape. Inside this frame-like section 8, a locking space 11 for receiving a fitting projection 10 of the opposing female connector housing 9 (FIG. 3) is constructed.

The pushing plate 7 is formed with a U-shape recess 12 receding from the central rear end portion thereof, and a pair of guide rails 13, 13 are formed protruding outwardly from the side plates 5, 5 at both sides of the pushing plate 7 for receiving the fitting detection member 2, the pushing plate 7 being further formed with a pair of guide grooves 14, 14 at both sides of the recess 12. Each of the guide grooves 14 is notched from the front end of the pushing plate 7 toward the rear end thereof, and a stopping portion 14*a* is formed at the rear end of each of the guide grooves.

Figure 2:
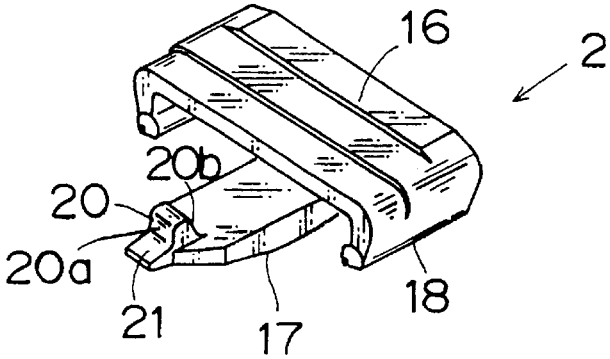
FIG. 2 is a perspective view showing a connector fitting detection member.
Figure 4:
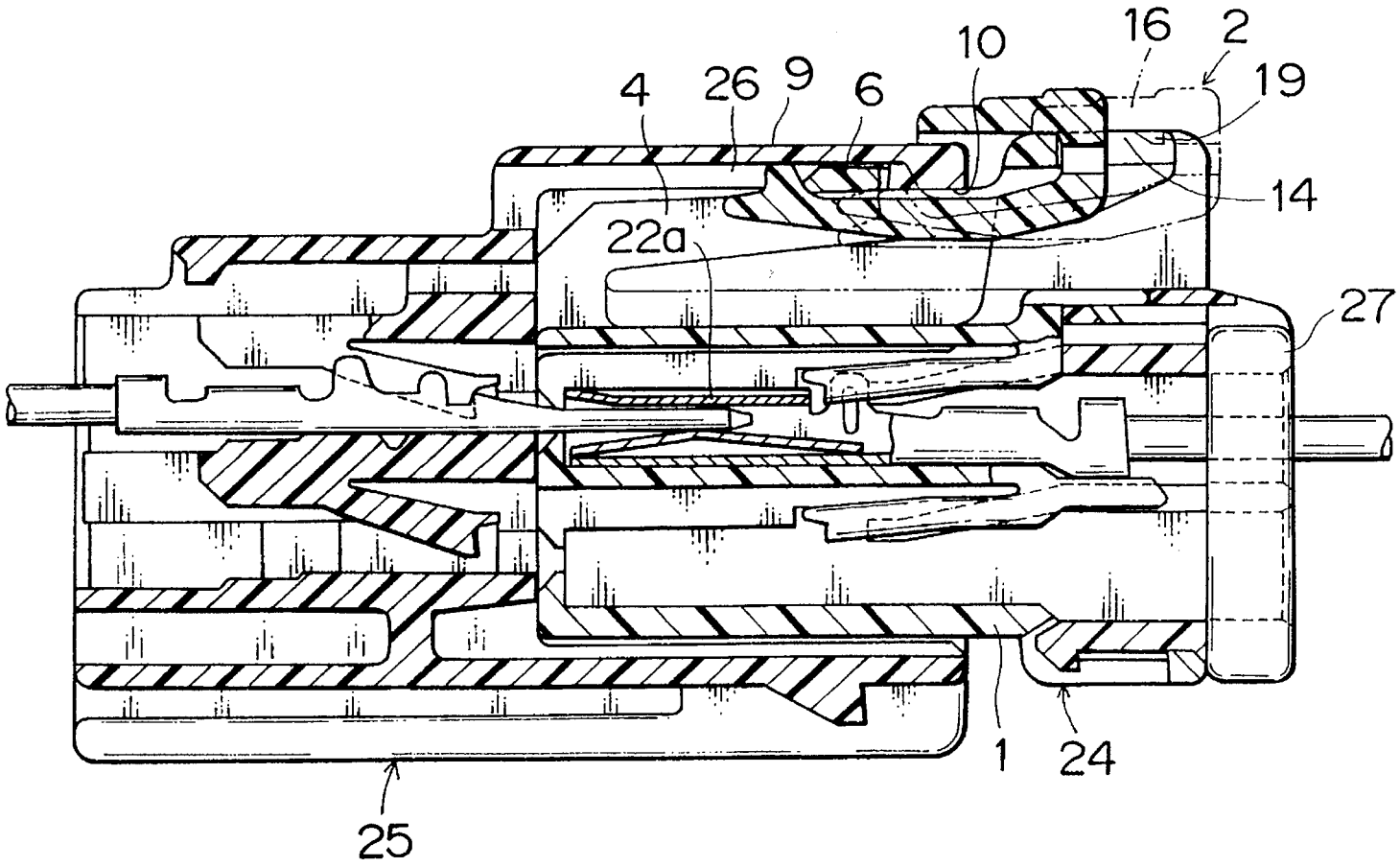
FIG. 4 is a longitudinal sectional view showing a state in which the two connectors are coupled to each other.

The fitting detection member 2 is composed of, as shown in FIG. 2, an operating section 16 that covers over the pushing plate 7 of the resilient locking arm 4 and a resilient detecting arm 17 which is downwardly protruded and extending forward from the rear end thereof. Both sides of the operating section 16 are downwardly extended and inwardly bent to make a hook-like shape, to compose a pair of fitting pieces 18, 18 to fit with the respective guide rails 13, 13. Further, as shown in FIG. 4, a pair of stopping projections 19, 19 are formed on the inner surface of the operating section 16 to be received in the respective guide grooves 14, 14. The resilient detecting arm 17 is protruded in a slightly downwardly arcuate shape from the center portion of the operating section 16, and the far end thereof is protruded in the forward direction further than the front end of the operating portion 16 itself. At the top end of the detecting arm 17, an upwardly directing locking projection 20 is formed to abut against the locking protuberance 6, and extended forwardly of the locking projection 20 is a tapering portion 21 having a substantially triangle sectional shape. The locking projection 20 is slightly inclined downward in the forward direction, and having a forwardly acute face 20*a* and a rearwardly obtuse face 20*b*.

Figure 3:
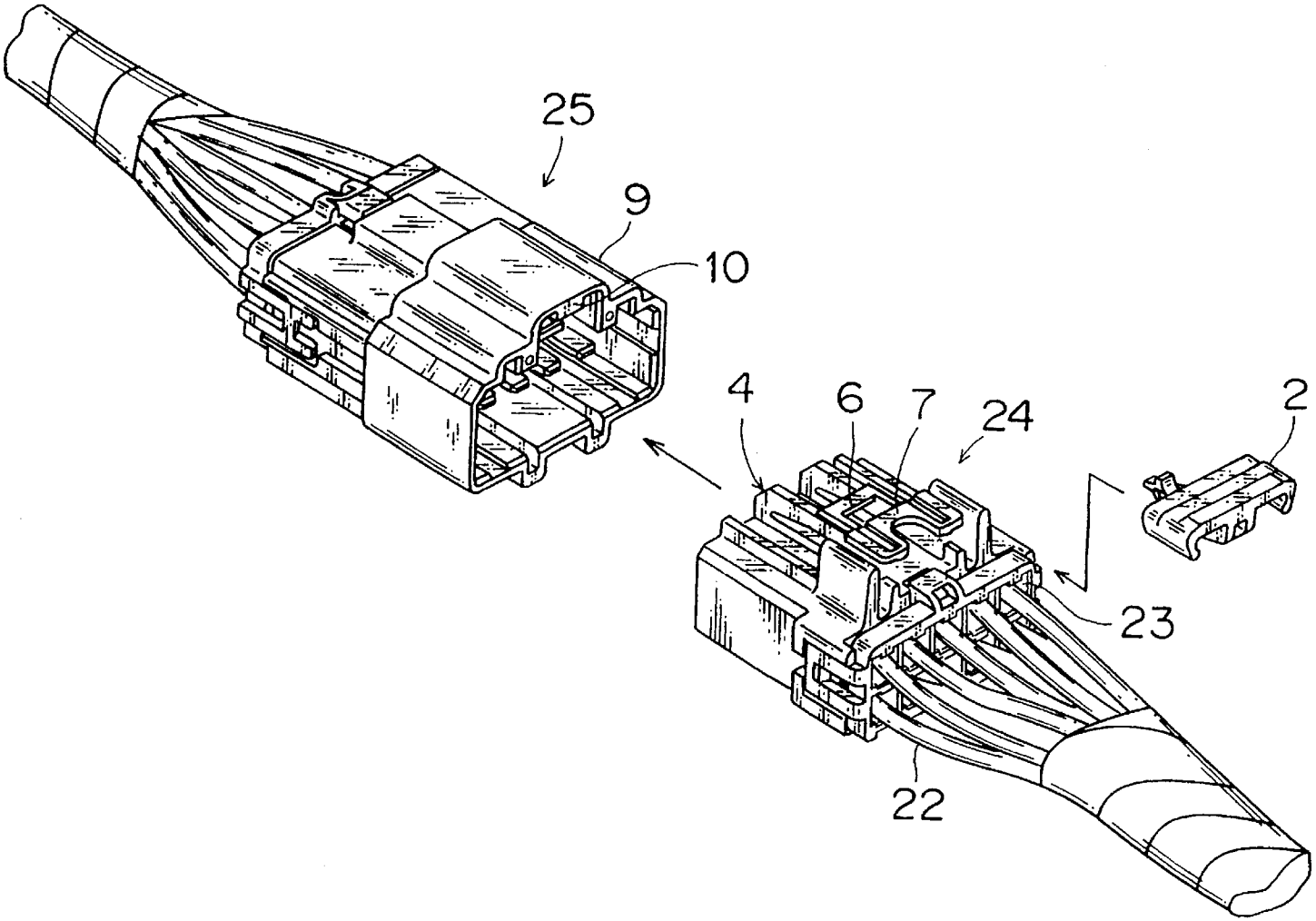
FIG. 3 is an exploded perspective view showing a state just before a male and female connectors are coupled with each other.

The fitting detection member 2 is mounted, as shown in FIG. 3, to the resilient locking arm 4 formed on a male connector 24 in which a plurality of electric wires with terminals are accommodated through the rear opening 23 thereof, and the male connector 24 is to be inserted and fitted in the mating female connector 25. At this stage, the resilient locking arm 4 is inserted into the upper fitting chamber 26 of a female connector housing 9 and the locking protuberance 6 surmounts the fitting projection 10 at the entrance of the fitting chamber. In this case, the fitting detection member 2 moves together with the locking arm 4. A female terminal 22*a* inserted into the male connector housing 1 is locked secondarily by a rear holder 27 at the rear portion of the housing.

Figure 5:
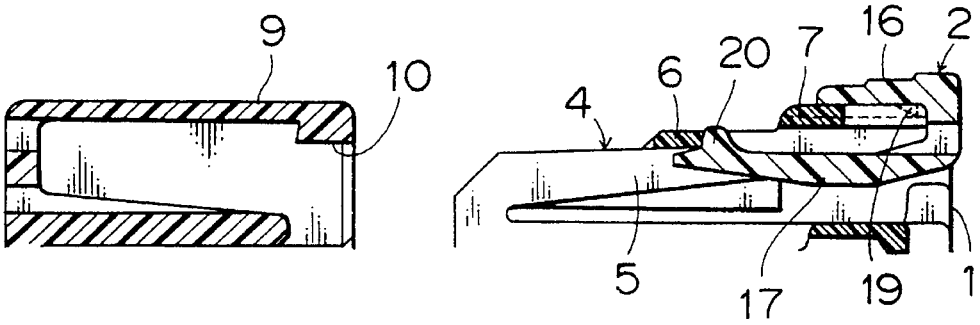
FIG. 5 is a longitudinal sectional view of an important portion of the embodiment showing a state just before the connectors are coupled for explaining the function of fitting detection member.
Figure 6:
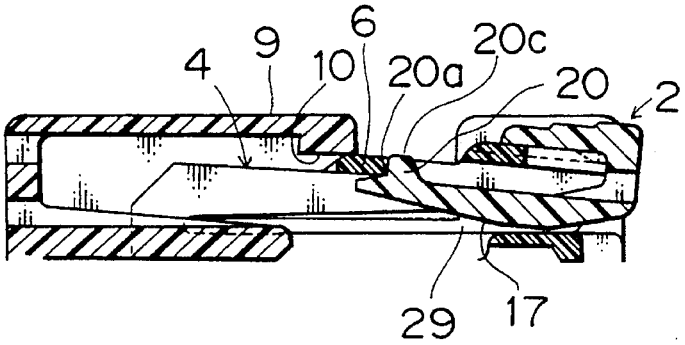
FIG. 6 is a longitudinal sectional view of an important portion of the embodiment showing a state in which the connectors are being coupled to each other.
Figure 7:
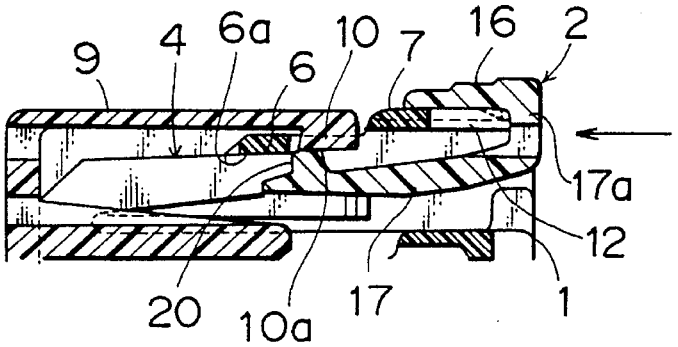
FIG. 7 is a longitudinal sectional view of an important portion of the embodiment showing a state in which the connectors are perfectly fitted with each other.

The movement of the fitting detection member 2 is shown in FIGS. 5 to 8, wherein before the coupling operation of the mating connectors, as shown in FIG. 5, the fitting detection member 2 is retained rather at the rear side of the locking arm 4, with the operating section 16 of the fitting detection member being laid on the pushing plate 7 of the resilient locking arm 4, the resilient detecting arm 17 being inserted between the opposite side plates 5, 5, and the locking projection 20 being abutted against the rear end of the locking protuberance 6. Here, a pair of fitting pieces 18, 18 are engaged with the guide rails 13, 13 respectively (FIG. 1), and engaged with the guide grooves 14, 14 are the stopping projections 19 in a forwardly slidable manner. Each of the stopping projection 19 is then abutted against the rear stopping end 14*a* each formed in the guide groove 14 thereby to prevent the fitting detection member 2 from coming off. Thereafter, when the locking protuberance 6 of the resilient locking arm 4 is deflected downward sliding along the fitting projection 10 of the female connector housing 9, the fitting detection member 2 also gets downward inside the deflection space 29 of the locking arm 4. Further, in the state that the mating two connectors are completely coupled with each other, as shown in FIG. 7, the locking protuberance 6 surmounts the fitting projection 10 and engaged with the rear end side of the fitting projection 10, and the locking arm 4 thus restores the deflection thereof. At this stage, the resilient detecting arm 17 of the fitting detection member 2 remains still deflected with the top portion 20*c* of the locking projection 20 thereof (FIG. 6) being abutted against the protruded end face (the lowest face) 10*a* of the fitting projection 10 of the female connector housing 9. When the fitting projection 10 is engaged with the locking protuberance 6 of the resilient locking arm 4, the protruded end faces (lowest face) 10*a*, 6*a* of the respective protruded portions 10 and 6 form a surface of the same level.

Figure 8:
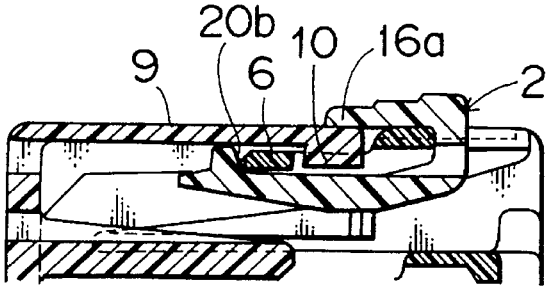
FIG. 8 PRIOR ART
FIG. 8 is a longitudinal sectional view of an important portion of the embodiment showing a state in which the fitting detection member is operated.
Figure 9:
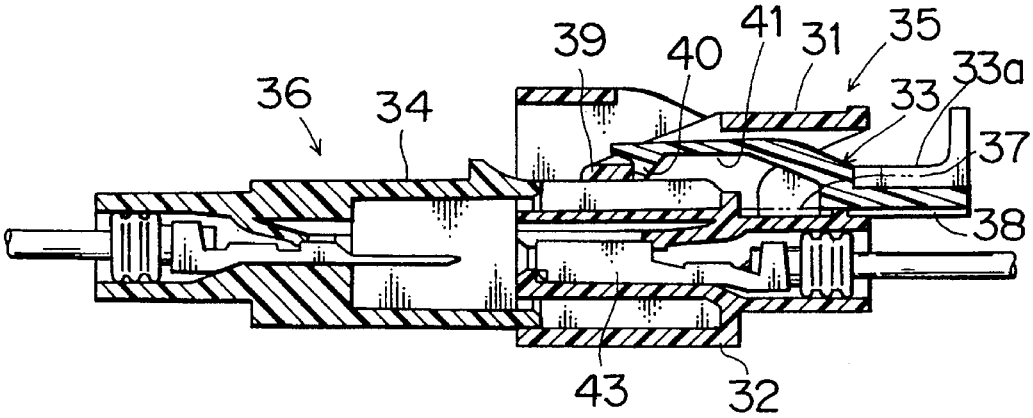
FIG. 9 PRIOR ART
FIG. 9 is a longitudinal sectional view showing a state just before two connectors are coupled to each other in the prior art.
Figure 10:
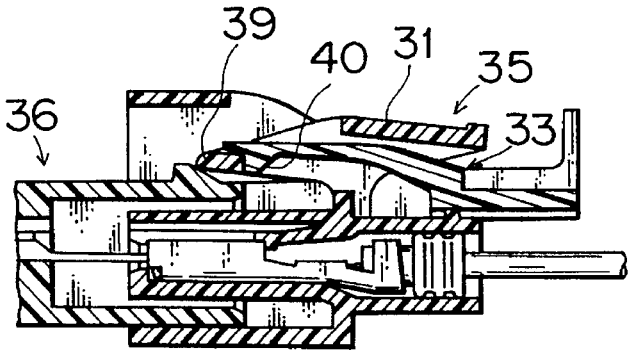
FIG. 10 PRIOR ART
FIG. 10 is a longitudinal sectional view showing a state in which two connectors in FIG. 9 are being coupled.
Figure 11:
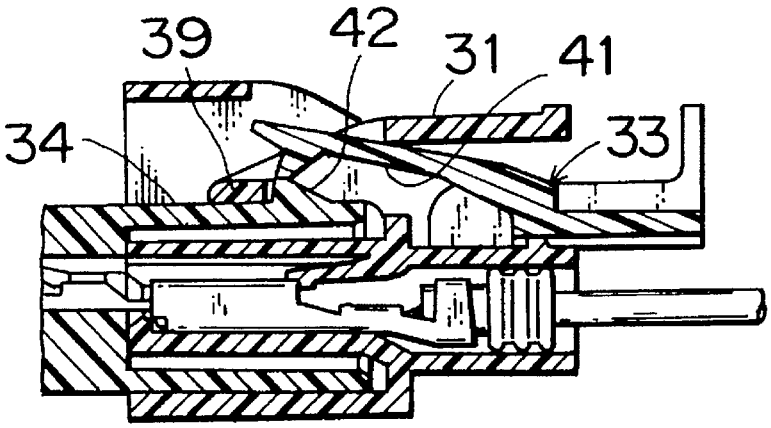
FIG. 11 PRIOR ART
FIG. 11 is a longitudinal sectional view showing a state in which the coupling of the connectors are perfectly coupled.
Figure 12:
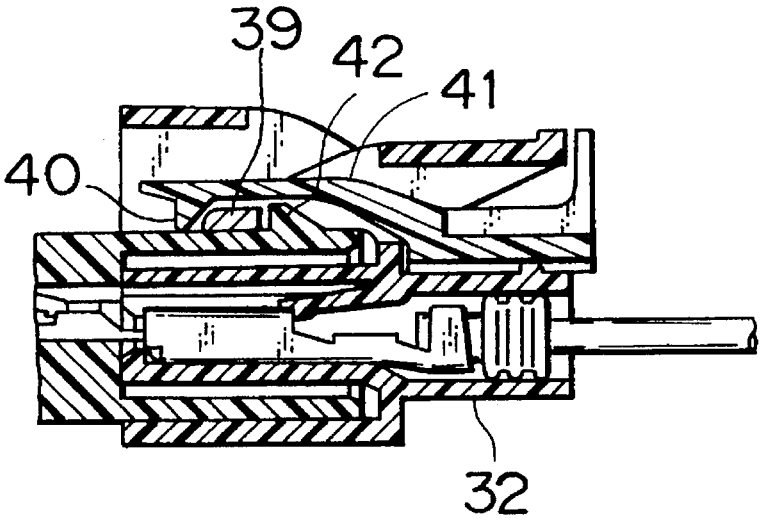
FIG. 12 PRIOR ART
FIG. 12 is a longitudinal sectional view showing a state in which a fitting detection member in the prior art is operated.

Here, if the rear end of the fitting detection member 2 is pushed in the direction shown by an arrow A, the operation section 16 slides forward on the pushing plate 7 of the locking arm 4, a vertical base portion 17*a* of the detecting arm 17 moves forward inside the recess 12 of the pushing plate 7, thereafter the locking projection 20 of the detecting arm 17 slidingly moves forward along the lowest surfaces 10*a* and 6*a* of the respective fitting projection 10 and the locking protuberance 6, so that the locking projection 20 restores the deflection thereof upward and as shown in FIG. 8, a front end portion 16*a* of the operating section 16 is then retained on the front end of the female connector housing 9. By sliding the fitting detection member 2, a perfect fitting of the male and female terminals, respectively 24, 25, is confirmed (FIG. 4).

As mentioned heretofore, when the two mating connectors are not in the coupled state as shown in FIG. 6, the acute-angled face 20*a* of the locking projection 20 of the resilient detecting arm 17 is abutted against the .locking protuberance 6 of the locking arm 4, and therefore, the fitting detection member 2 is prevented from sliding forward, and thereby an imperfect fitting of the connectors is detected. Further, since he detecting arm 17 does not deflect during the resilient locking arm 4 is being deflected, a force required for operating the locking arm 4 is not enlarged, and thus a smooth connection and disconnection of connectors can be realized. Still further, when the fitting detection member 2 is in the initial state of its operation as shown in FIG. 6, the operating section 16 thereof is retained on the pushing plate 7 of the Fear portion of the locking arm 4, so that the fitting detection member 2 never protrudes from the reap end portion of the male connector housing 1.

It is to be noted that for disconnecting the male connector 24 from the female connector 25 (FIG. 4), at first from the state shown in FIG. 8 wherein the connectors are completely fitted with each other slide the fitting detection member 2 rearwardly as shown in FIG. 7, then pressing downward the operating section 16 of the fitting detecting member 2 as shown in FIG. 6 to deflect the locking arm 4 so as to release it. In pulling the fitting detection member 2 backward, the rear obtuse slanted face 20*b* (FIG. 8) of the locking projection 20 is slid along the locking protuberance quite smoothly.

[EFFECT OF THE INVENTION]

As explained heretofore, according to the present invention, since the fitting detection member is retained on the resilient locking arm of the connector housing, and that it never protrudes from the rear end of the locking arm, an inadvertent removal of the fitting detection member due to an external friction during the transportation thereof or the like, and an insufficient insertion of terminals from rear side of the housing during an automatic insertion of terminals can be perfectly prevented. Furthermore, since the detecting arm of the fitting detection member never deflects together with the locking arm during the connector coupling operation, a force required for coupling the connectors is not enlarged as was often observed conventionally, and still further, an operating force of the locking arm for disconnecting the connectors is not augmented either, so that a smooth connection and/or disconnection can be realized.

While the invention has been-described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A mechanism for detecting a perfect fitting of two mating connectors, comprising:

a first connector housing;

second connector housing;

a resilient locking arm provided on said first connector housing, said resilient locking arm including a locking protuberance and a pushing plate having a pair of guide rails formed on both sides thereof;

a fitting projection formed on said second connector housing for engaging said locking protuberance of said first connector housing;

a fitting detection means slidably mounted on said first connector housing for coupling with said resilient locking arm of said first connector housing;

an operating section provided on said fitting detection means which covers said pushing plate when coupled with said locking arm, said operating section having a pair of fitting pieces on both sides thereof for slidably engaging said pair of guide rails of said resilient locking arm; and a resilient fitting detecting arm provided on said fitting detection means and having a locking projection for engaging said locking protuberance, wherein said locking projection is slidable on a respective lowest end surface of said fitting projection and said locking protuberance when the connectors are coupled with each other.

2. A mechanism for detecting a perfect fitting of mating connectors as claimed in claim 1, wherein said resilient fitting detecting arm is integrally formed to said operating section to be urged downward with respect to said pushing plate.

3. A mechanism for detecting a perfect fitting of mating connectors as claimed in claim 1, wherein said guiding section is formed with a pair of guide grooves at respective lateral sides thereof, and said operating section of the fitting detection means is formed with a pair of stopping projections to be received and retained in said guide grooves for preventing said operating section coming off rearwardly.

* * * * *